US011142979B2

(12) United States Patent
Becker

(10) Patent No.: US 11,142,979 B2
(45) Date of Patent: Oct. 12, 2021

(54) PUMP DOWN ASSIST WIRELINE DEVICE AND METHOD

(71) Applicant: DUCON—BECKER SERVICE TECHNOLOGY, LLC., Ventura, CA (US)

(72) Inventor: Billy G. Becker, Ventura, CA (US)

(73) Assignee: DUCON—BECKER SERVICE TECHNOLOGY, Ventura, CA (US)

( * ) Notice: Subject to any disclaimer, the term of this patent is extended or adjusted under 35 U.S.C. 154(b) by 0 days.

(21) Appl. No.: 16/815,897

(22) Filed: Mar. 11, 2020

(65) Prior Publication Data

US 2020/0318449 A1 Oct. 8, 2020

Related U.S. Application Data

(60) Provisional application No. 62/829,135, filed on Apr. 4, 2019.

(51) Int. Cl.

| | |
|---|---|
| ***E21B 23/10*** | (2006.01) |
| ***E21B 37/10*** | (2006.01) |
| ***E21B 34/06*** | (2006.01) |

(52) U.S. Cl.

CPC ..... *E21B 23/10* (2013.01); *E21B 34/06* (2013.01); *E21B 37/10* (2013.01)

(58) Field of Classification Search

CPC ..... E21B 23/10; E21B 37/10; E21B 37/04

See application file for complete search history.

(56) References Cited

U.S. PATENT DOCUMENTS

| | | | | |
|---|---|---|---|---|
| 3,065,807 | A | 11/1962 | Wells | |
| 3,104,714 | A * | 9/1963 | Terrel et al. | E21B 23/04 166/153 |
| 3,216,512 | A | 11/1965 | Grable | |
| 3,489,438 | A | 1/1970 | Mcclure | |
| 4,729,429 | A * | 3/1988 | Wittrisch | E21B 23/14 166/66.7 |
| 4,997,048 | A | 3/1991 | Isom | |
| 5,180,009 | A * | 1/1993 | Sneed | E21B 23/10 166/155 |
| 5,209,304 | A * | 5/1993 | Nice | E21B 23/10 166/154 |
| 5,775,736 | A | 7/1998 | Svetlik | |
| 5,911,278 | A | 6/1999 | Reitz | |
| 6,138,764 | A * | 10/2000 | Scarsdale | E21B 23/08 166/117.6 |
| 6,595,282 | B2 * | 7/2003 | Smith, Jr. | E21B 33/16 166/177.3 |

(Continued)

OTHER PUBLICATIONS

International Search Report in related/corresponding PCT Application No. PCT/US2019/054387 dated Feb. 4, 2020.

*Primary Examiner* — Shane Bomar

(74) *Attorney, Agent, or Firm* — Patent Portfolio Builders PLLC

(57) ABSTRACT

An assist device for propelling a tool through a conduit, the assist device including an upstream housing having a first port; a downstream housing movably attached to the upstream housing and the downstream housing having a second port; and a swab element attached to the downstream housing. The first port is closed when there is no gap between the upstream housing and the downstream housing, and the first port is open when there is a gap between the upstream housing and the downstream housing.

35 Claims, 15 Drawing Sheets

(56) References Cited

U.S. PATENT DOCUMENTS

| | | | | |
|---|---|---|---|---|
| 10,301,927 | B2 * | 5/2019 | Sallwasser | E21B 34/14 |
| 10,927,650 | B2 * | 2/2021 | Schultz | E21B 43/26 |
| 2007/0227739 | A1 * | 10/2007 | Becker | E21B 43/123 166/319 |
| 2007/0235197 | A1 * | 10/2007 | Becker | E21B 43/123 166/372 |
| 2014/0158350 | A1 * | 6/2014 | Castillo | E21B 23/10 166/250.17 |
| 2015/0247375 | A1 * | 9/2015 | Stout | E21B 33/1265 166/308.1 |

* cited by examiner

PUMP DOWN ASSIST WIRELINE DEVICE AND METHOD

BACKGROUND

Technical Field

Embodiments of the subject matter disclosed herein generally relate to well operations that involve deploying/retrieving a tool in a well, and more specifically, to pumping down operations that take place in the well for either removing or deploying a well tool with a wireline.

Discussion of the Background

Once a well is drilled to a desired depth relative to the surface, and a casing protecting the wellbore is installed, various operations are performed for connecting the wellbore to a subterranean formation, and/or for bringing the content of the subterranean formation to the surface. For example, sometimes a packer needs to be installed at the toe of the well, or a gun needs to be positioned to a certain depth for perforating the casing, or various valves needs to be installed in a production string. Any of these operations typically uses a pump down operation for achieving its goal.

A traditional pump down operation is illustrated in FIG. 1. Note that the well system 100 shown in FIG. 1 is schematically illustrated and many details and components have been omitted for simplicity. The well system 100 includes, inter alia, a wireline 110 and a tool 120, which is attached to the wireline 110. The wireline 110 is metered from a spooling unit 112. The wireline 110 and the tool 120 are deployed inside of a casing 102 of the well 104. A pump 114 may be connected to the wellhead 116 and is configured to supply a fluid or to lift a fluid from the well, depending on the stage of the well.

The tool 120 advances to its desired location mainly due to its gravity. Once in position, the tool 120 may be deployed in a pocket of the casing (e.g., if the tool is a gas lift valve), or it may be deployed to seal the casing (e.g., if the tool is a packer). Other goals may be achieved with this or other tools. Once the tool has been deployed, a connection mechanism 111, which is provided between the wireline and the tool, may be activated to release the tool 120. Then, the wireline 110 is brought back to the surface, at the spooling unit 112.

For this type of vertical deployment, the gravity is mainly the deployment "engine" for the tool 120. However, modern wells are deviated from the vertical, with an example of a horizontal well shown in FIG. 2. For this type of well, the gravity does not help to deploy the tool 120 at the toe of the well. Thus, the pump 114 is used to pump down the tool. To achieve this goal, the pump 114 pumps a fluid 210 above the tool 120, and in this way the tool 120 is pushed to the desired position in the non-vertical portion of the well. However, for this process to work, an area of the cross-section of the connection mechanism 111 attached to the wireline 110 needs to be close to the area of the cross-section of the casing 102, so that not too much pressure escapes past the connection mechanism and the tool 120.

This large cross-section area of the connection mechanism 111 helps to deliver the tool 120 at the desired position in the well, but becomes a burden when the wireline 110 is brought back to the surface because the connection mechanism 11*l* faces now all the fluid 210 that sits above it, and tends to bring that fluid back to the surface, which require a large amount of energy, and is a slow process.

It is also possible that the tool 120 has a small cross-section area, and then, the connecting device 111 has a similar small area. While this arrangement solves the problem of bypassing the fluid 210 when the wireline is pulled out of the well, it does not offer enough force when the wireline 110 is pumped down into the well to deliver the tool 120 at the desired location.

Thus, there is a need for a new well device that can assist the wireline to deliver the tool 120, irrespective of its cross-sectional area, to a desired location in a non-vertical well, but also to avoid the problem of pushing the fluid 210 to the surface when retrieved from the well.

SUMMARY

According to an embodiment, there is an assist device for propelling a tool through a conduit. The assist device includes an upstream housing having a first port, a downstream housing movably attached to the upstream housing and the downstream housing having a second port, and a swab element attached to the downstream housing. The first port is closed when there is no gap between the upstream housing and the downstream housing, and the first port is open when there is a gap between the upstream housing and the downstream housing.

According to another embodiment, there is a well system for deploying a well tool at a desired position in a well. The well system includes a wireline, an assist device attached to the wireline, and a well tool attached to the assist device. The assist device has a swab element that seals a pipe in which the assist device is deployed, so that a fluid above the assist device pushes the swab element down the pipe.

According to still another embodiment, there is a method for deploying/retrieving a well tool in a well. The method includes lowering into a pipe located within the well, an assist device that has a swab element that contacts a bore of the pipe, pumping a fluid on top of the assist device, moving the assist device down the pipe without allowing the fluid to pass by the swab element, and pulling the assist device up the pipe while automatically opening a first port of the assist device to allow the fluid above the assist device to bypass the swab element through an internal conduit of the assist device.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a pump down assist wireline tool that delivers a valve into a corresponding mandrel in a non-vertical part of a well. However, the embodiments discussed herein are also applicable to a vertical well or a tool different than a valve.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a novel pump down assist wireline device (called herein an assist device) provides a more positive interface device with the wireline for allowing the hydraulic pumping down movement to a desired depth regardless of the well's inclination, and also provides a consistent way for the wireline tools to easily move upward, without pushing upwards the column of fluid above the assist device. An internal by-pass port is actuated within the assist device by wireline pulling tension, making an easy upward pull due to the fact that the fluid above the assist device is allowed to move through the by-pass port to a region behind the assist device. The assist device is now discussed in more detail with regard to the figures.

Figure 1:
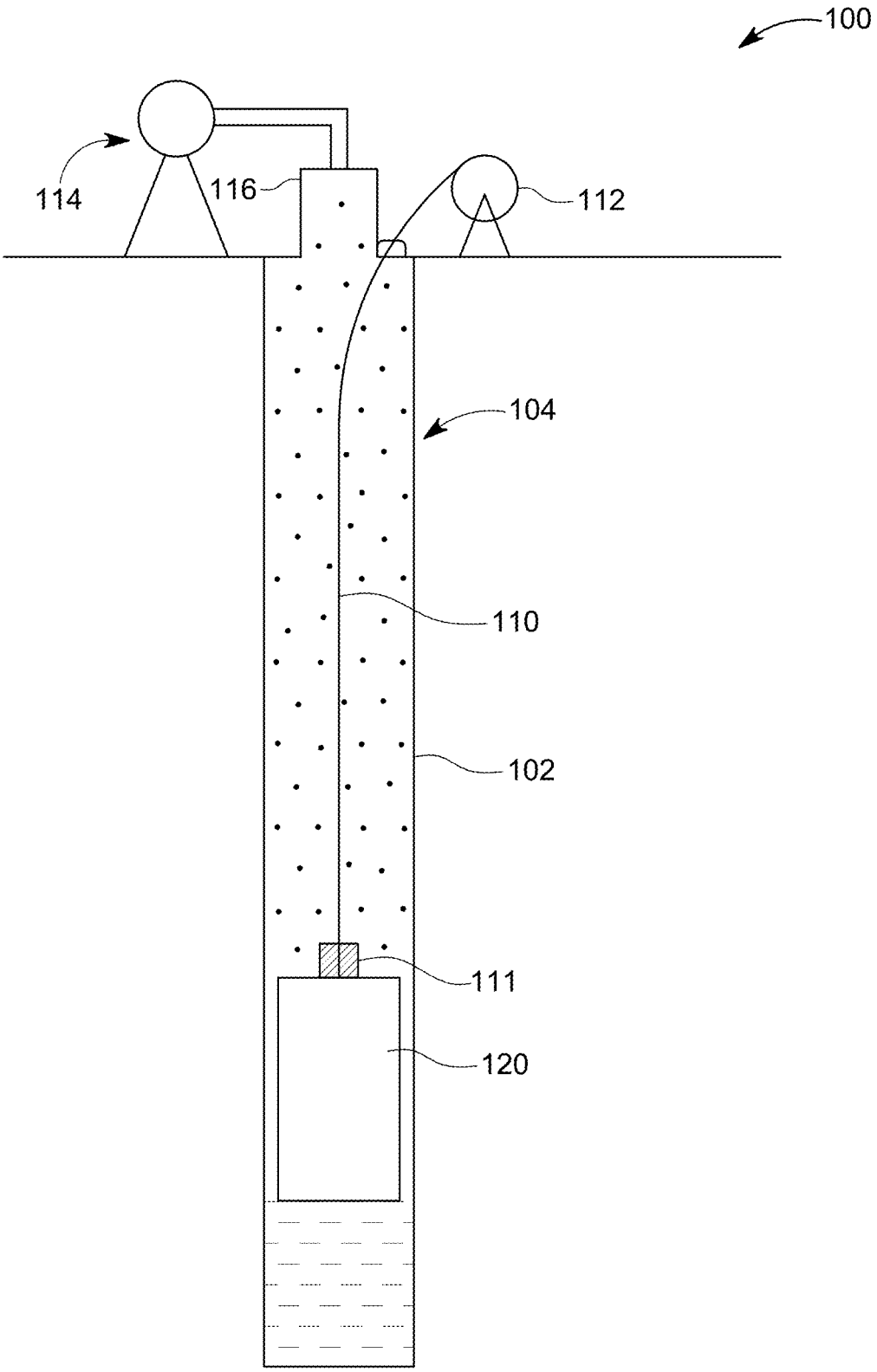
FIG. 1 illustrates a well tool that is lowered with a wireline in a vertical well using the weight of the tool.
Figure 2:
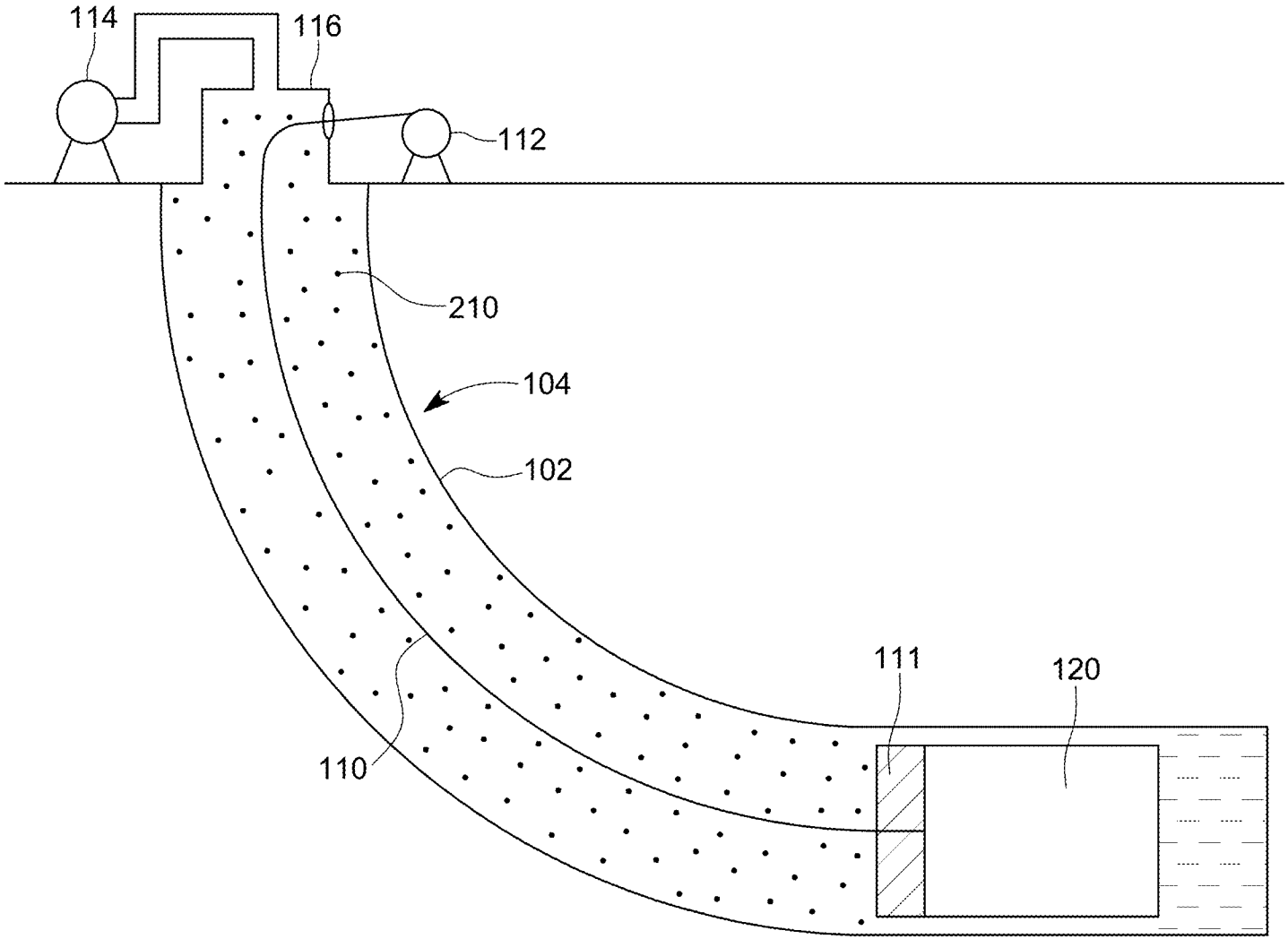
FIG. 2 illustrates a process of pumping down a tool in a non-vertical well using a large cross-section device.
Figure 3:
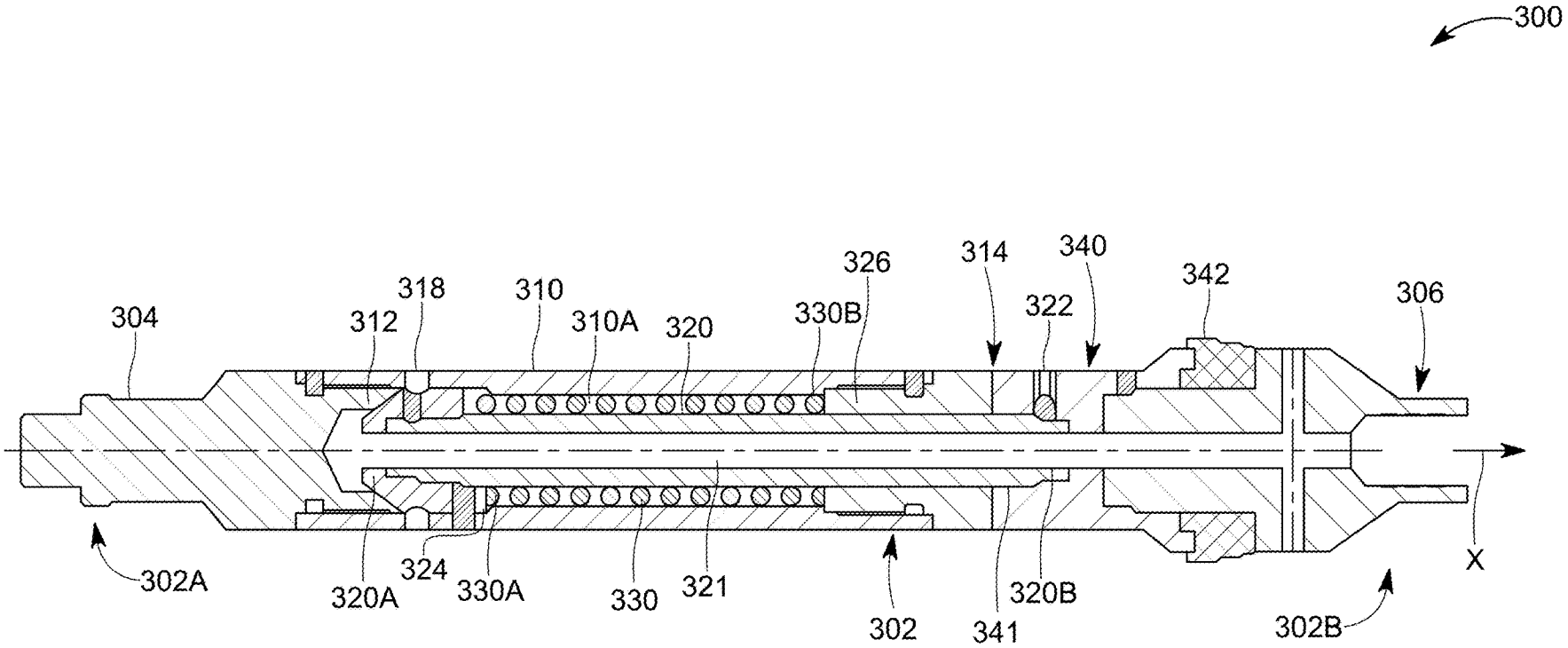
FIG. 3 illustrates an assist device that is configured to be pumped down in a non-vertical well to deploy/retrieve a tool.

FIG. 3 shows the pump down assist wireline device 300 having an elongated body 302 along a longitudinal axis X. The body 302 is equipped, at an upstream end 302A, with a top wireline connection 304, and at a downstream end 302B, with a bottom wireline connection 306. The body 302 is made of two separated housings, an upstream housing 310 and a downstream housing 340. Note that the term "upstream" generally indicates a direction in the well that points to a head of the well while the term "downstream" generally indicates a direction in the well that points to an end of the well (e.g., a toe for a horizontal well). An interface 314 between the upstream and downstream housings is shown in FIG. 3. The upstream housing and the downstream housing are in contact with each other at this interface when the assist device is in a closed state. The two housings make a gap when the assist device is in an open state.

The upstream housing is configured to move relative to the downstream housing. To achieve this result, a stem 320 is placed inside corresponding bores of the upstream and downstream housings, as illustrated in FIG. 3. The upstream end of the stem 320 (called herein the head 320A) is free to move inside a bore 310A of the upstream housing 310, for a given distance, which is discussed later. The downstream end of the stem 320 (which is called herein the tail 320B) is fixed inside a bore 341 of the downstream housing 340, for example, with a screw 322. Those skilled in the art would understand that other means may be used for attaching this end of the stem to the downstream housing, for example, using threads formed directly on the stem.

Figure 4:
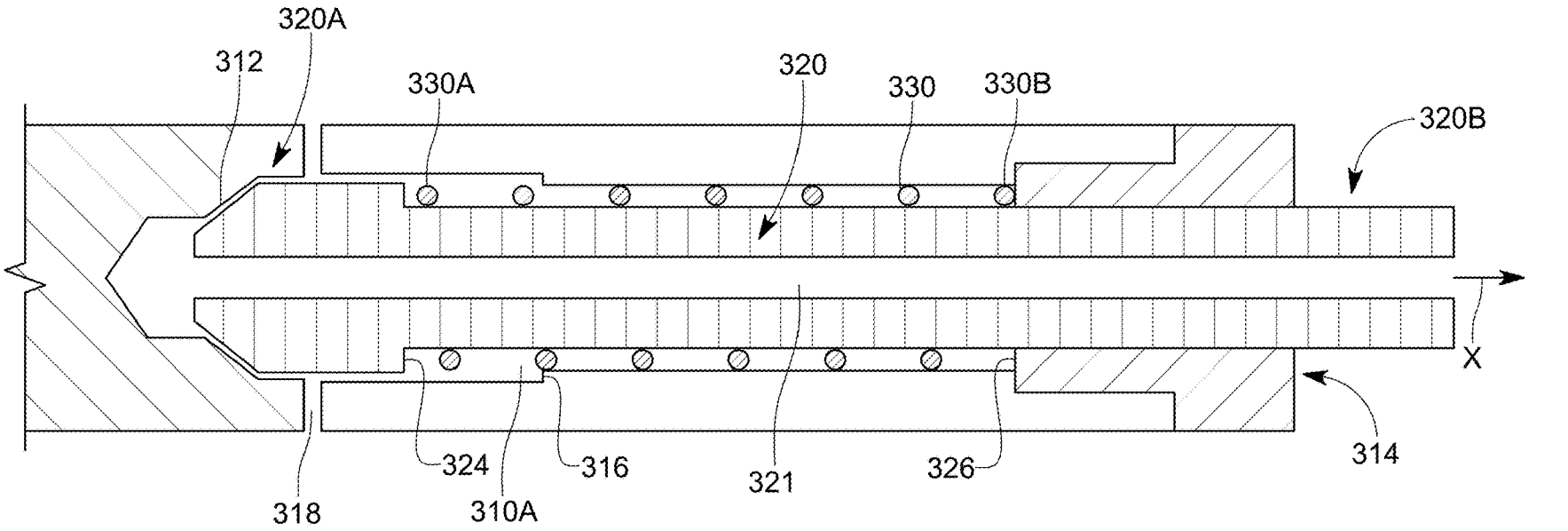
FIG. 4 illustrates an upstream housing of the assist device.

A spring 330 is deployed inside the bore 310A of the upstream housing 310, around the stem 320. The upstream end 330A of the spring 330 is in contact with the head 320A of the stem 320. For example, the head 320A of the stem 320 has a larger diameter then the remaining part of the stem, as shown in FIGS. 3 and 4, and thus it forms a shoulder 324. The upstream end 330A of the spring 330 is biased against the shoulder 324. The downstream end 330B of the spring 330 is also located inside the bore 310A of the upstream housing 310, and facing a shoulder 326, which is part of the upstream housing 310, as shown in FIG. 4. The spring 330 is stretched with a predetermined amount to maintain to maintain the upstream and downstream housings next to each other, with no gap.

The stem 320 has a bore 321, see FIG. 4, that extends all the way from the head 320A to the tail 320B. FIG. 4 omits the downstream housing 340 for clarity. The stem 320 can move within the upstream housing 310, along the longitudinal axis X, until the shoulder 324 of the head 320A encounters a shoulder 316 formed inside the bore 310A. The shoulder 316 is part of the upstream housing 310. The upstream housing 310 has one or more ports 318 that are closed by the head 320A of the stem 320, when the assist device is in a closed position, as illustrated in FIGS. 3 and 4. Port 318 fluidly communicates the bore 310A of the upstream housing 310 with an exterior of the body 302 when the head 320A moves away from this port. Note that a seat 312 is formed into the upstream housing 310 and this seat is configured to receive the head 320A of the stem 320. The seat 312 and the head 320A acts as a valve, which is closed during the closed state of the assist device.

Figure 5:
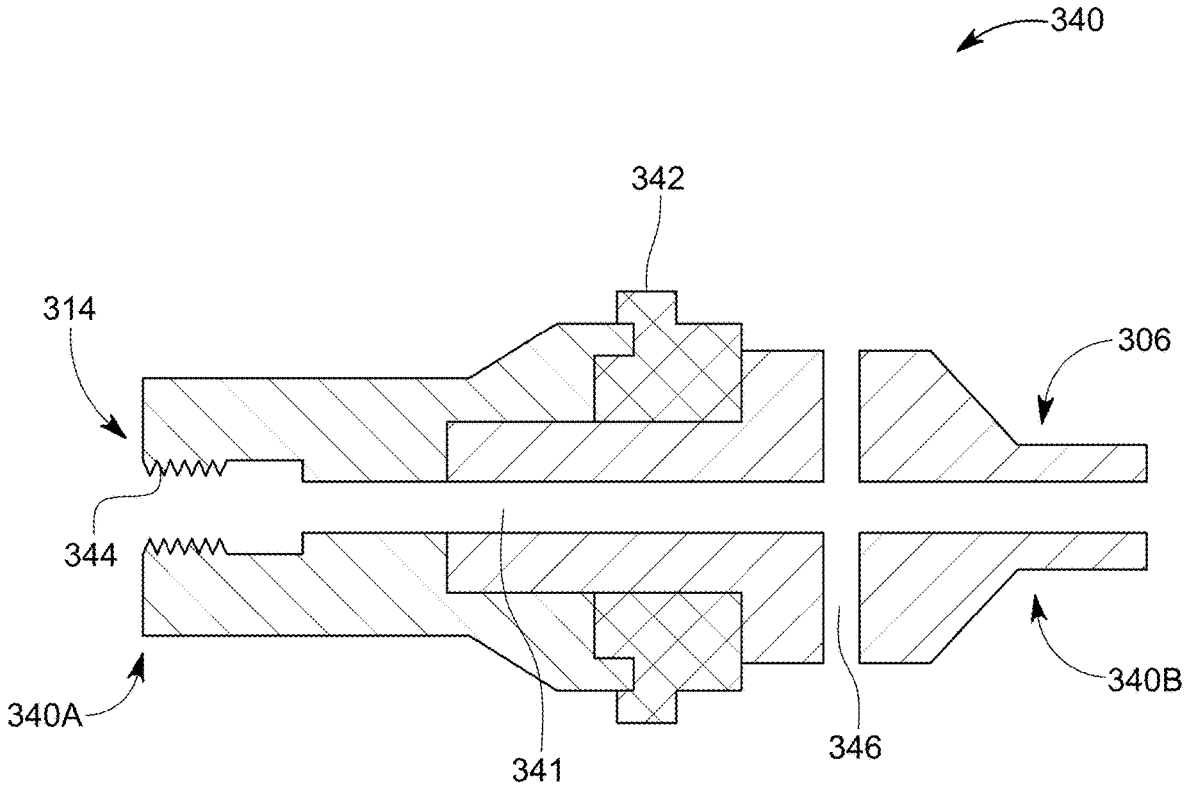
FIG. 5 illustrates a downstream housing of the assist device.

Returning to FIG. 3, the downstream housing 340 has a swab element 342 (called herein a swab cup because of its shape, but other shapes may be used) attached to an exterior surface of the housing. FIG. 5 shows in more detail the downstream housing 340 and how the swab cup 342 is attached to the exterior of the housing. The swab cup 342 has a circular shape and completely encloses the downstream housing. The swab cup 342 is sized to be in contact with the casing of the well, when the assist device is deployed in the casing, for reasons discussed later. While the upstream and downstream housings are desired to be made from a strong material, the swab cup 342 is made from a more flexible material so that the swab cup 342 bends when in contact with the casing of the well, to better seal it. In one example, the swab cup 342 is made of a polymer or rubber or rubber like materials.

FIG. 5 also shows that the downstream housing 340 has the bore 341 extending all the way from its upstream end 340A to the downstream end 340B. Note that the bore 310A of the upstream housing 310 does not extend all the way through the upstream housing. The upstream part of the bore 341 is configured to receive the tail 320B of the stem 320. As previously discussed, the tail portion 320B of the stem 320 can be fixedly attached to upstream end 340A of the downstream housing 340 with a screw, or with threads 344 as shown in FIG. 5. Further, FIG. 5 shows that the downstream housing 340 has one or more ports 346, formed in a wall of the housing and intersecting the bore 341. The ports fluidly communicate the bore 341 with an outside of the downstream housing. Ports 346 are continuously open and in communication with the bore of the casing of the well and these ports will ensure that the fluid above the assist tool 300 can move out of the bore 341, as now discussed.

Figure 6A:
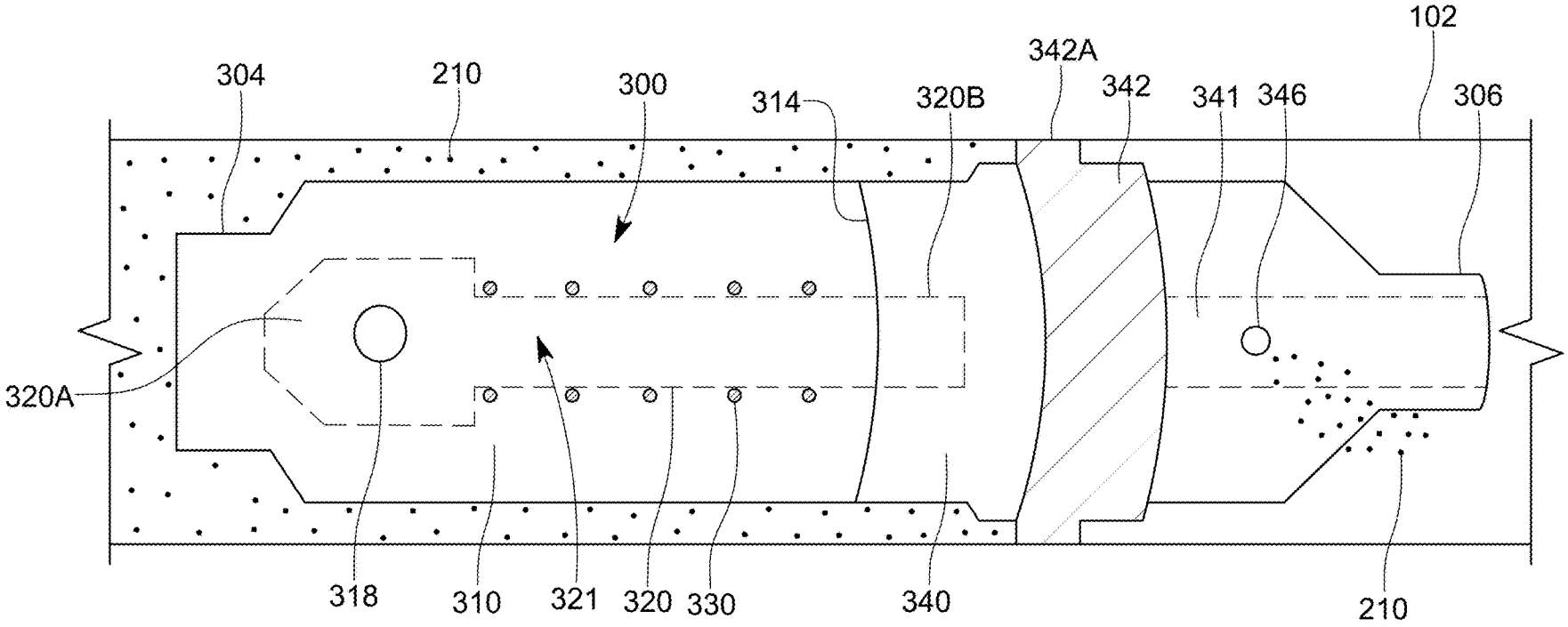
FIGS. 6A and 6B illustrate how the assist device opens and closes.

FIG. 6A schematically illustrates the assist device 300 being deployed in the casing 102. For simplicity, the wireline and other tools attached to the downstream end of the assist device are omitted. If fluid 210 is pumped by the pump (not shown) or another pressure control device located at the head of the well (upstream direction is to the left and downstream direction is to the right in the figure), then the fluid moves past the upstream housing of the assist device 300, up to the swab cup 342. As previously discussed, the swab cup is selected to have a diameter as large as the diameter of the casing 102, or even larger, so that a good contact is ensured between the outside surface of the swab cup 342 and the bore of the casing 102. Because of this good contact, the pressured fluid 210 cannot pass the swab cup 342 and thus, the pressured fluid is exerting a force on the swab cup and is pushing the swab cup in the downstream direction, toward the end of the well. This action happens for a vertical or a non-vertical well. Thus, the problems experienced by the traditional wireline tools in a non-vertical well are overcome by the presence of the swab cup that drastically limits the passage of the fluid 210 past the assist device. The more pressure is applied by the pump to the fluid 210, the stronger the assist device 300 is moved toward the end of the well.

Because the head 320A of the stem 320 blocks the port 318, no pressured fluid 210 is allowed to enter through the port 318 into the bore 310A of the upstream housing. Thus, the pressurized fluid 210 has no other choice but to push the entire assist device 300 downstream.

Figure 6B:
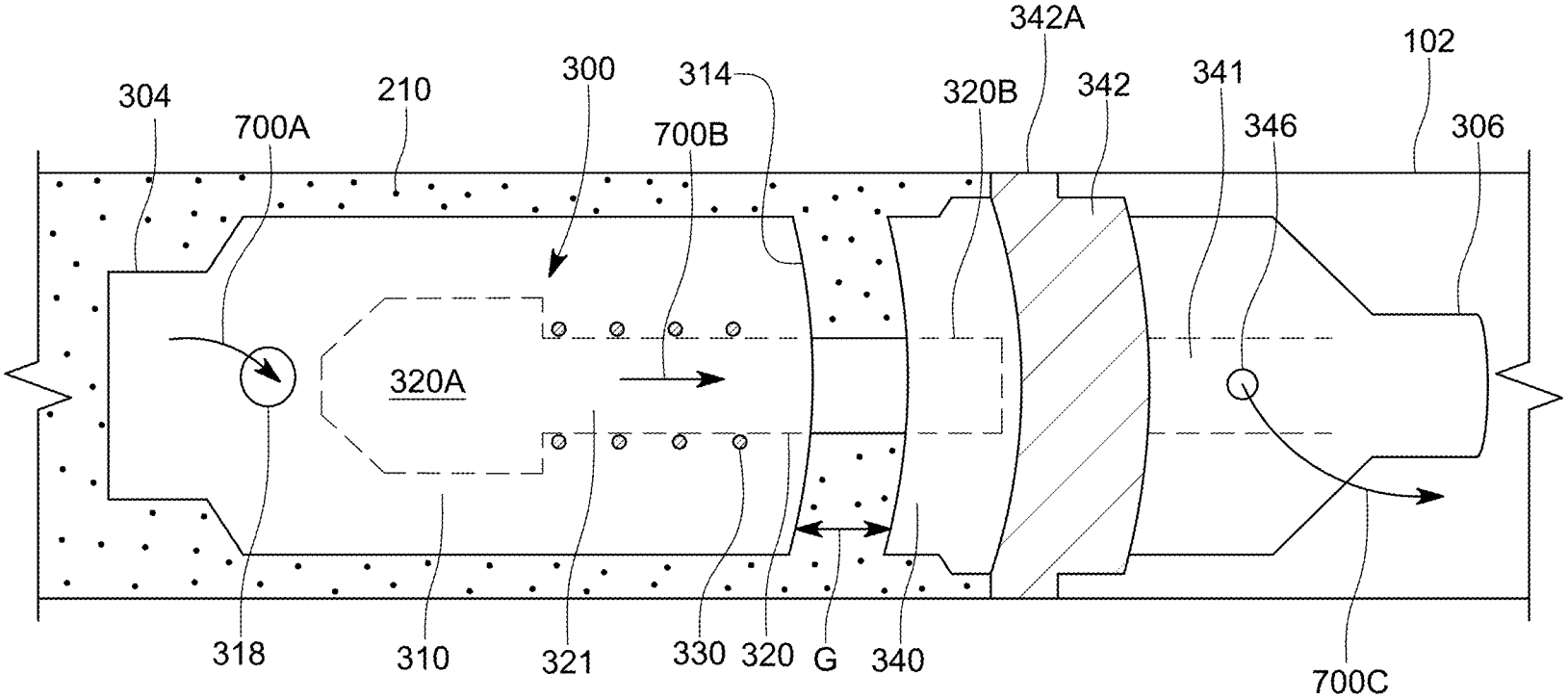
Figure 7:
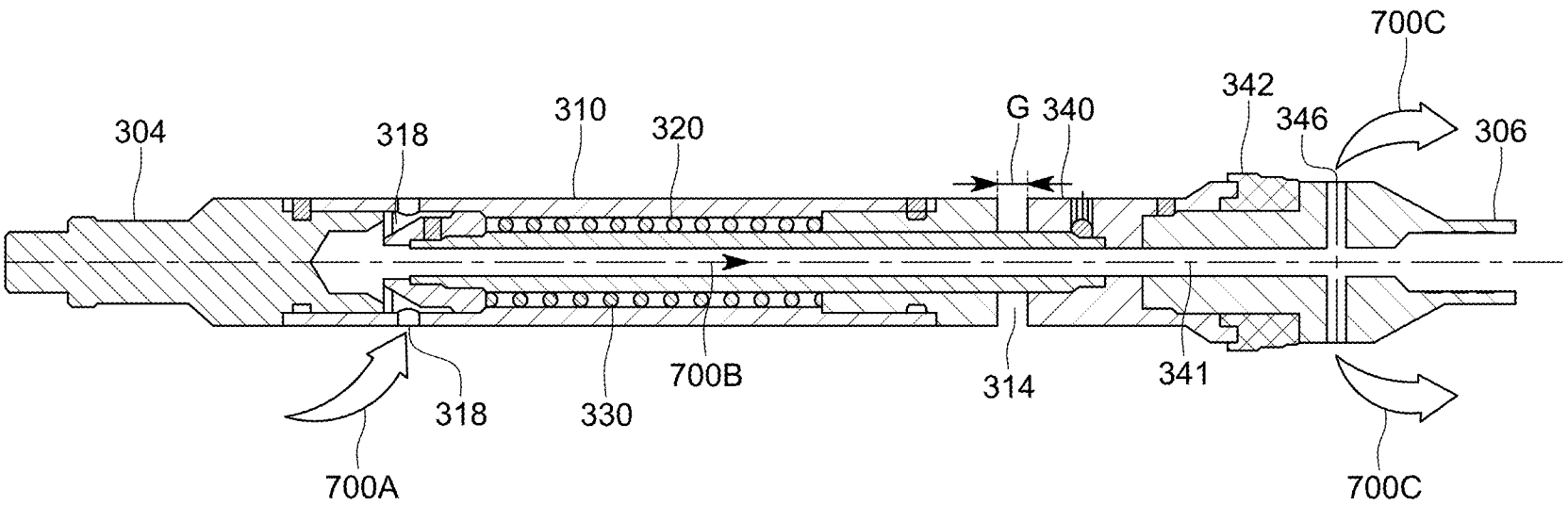
FIG. 7 illustrates the assist device being in an open state.

However, when the assist device is pulled out from the well, the situation changes. The pump is not pumping the fluid 210. However, the well is now full with the fluid 210, which means that there is a column of fluid above the assist device, all the way to the head of the well, and this column of fluid exerts a large force on the swab cup 342. When the assist device 300 is pulled upwards, the upstream housing 310 starts to move away from the downstream housing 340 because the force exerted by the column of fluid is larger on the downstream housing 340, due to the swab cup 342, then on the upstream housing 310. This relative motion of the upstream housing 310 is limited by the shoulder 316 discussed above with regard to FIG. 4. When the head 320A of the stem 320 contacts the shoulder 316, the relative motion of the upstream housing relative to the downstream housing is stopped. A gap G is formed between the upstream and downstream housings as shown in FIG. 6B. However, this limited motion of the upstream housing opens up port 318, as also illustrated in FIG. 6B, because the head 320A of the stem 320 moves downstream, toward the downstream housing. For this case, as illustrated in FIGS. 6B and 7, the fluid 210 is now able to pass through the port 318, into the bore 321 of the stem 320, along the path 700A. Then, the fluid moves along path 700B, through the bore 321 and into the bore 341 of the downstream housing 340 and finally escapes outside the assist device 300, at port 346, along path 700C. Note that because port 346 is placed downstream the swab cup 342, the fluid 210 can now move unimpeded from above the assist device, through the assist device, and then out of the assist device 300, along the paths 700A, 700B, and 700C.

Thus, as the assist device 300 is moving upwards in the well, the fluid 210 that is present above it, is now allowed to move along paths 700A to 700C and bypass the entire assist device 300, although the swab cup 342 is still pressing against the casing 102, and not allowing this fluid to pass the assist device through the annulus formed between the assist device and the casing. When the assist device is stopped and lowered again into the well, the upward force exerted on the upstream housing by the wireline is removed, which makes the spring 300 to bring the upstream housing back in contact with the downstream housing, and thus reduce the gap G to zero or almost zero.

Figure 8:
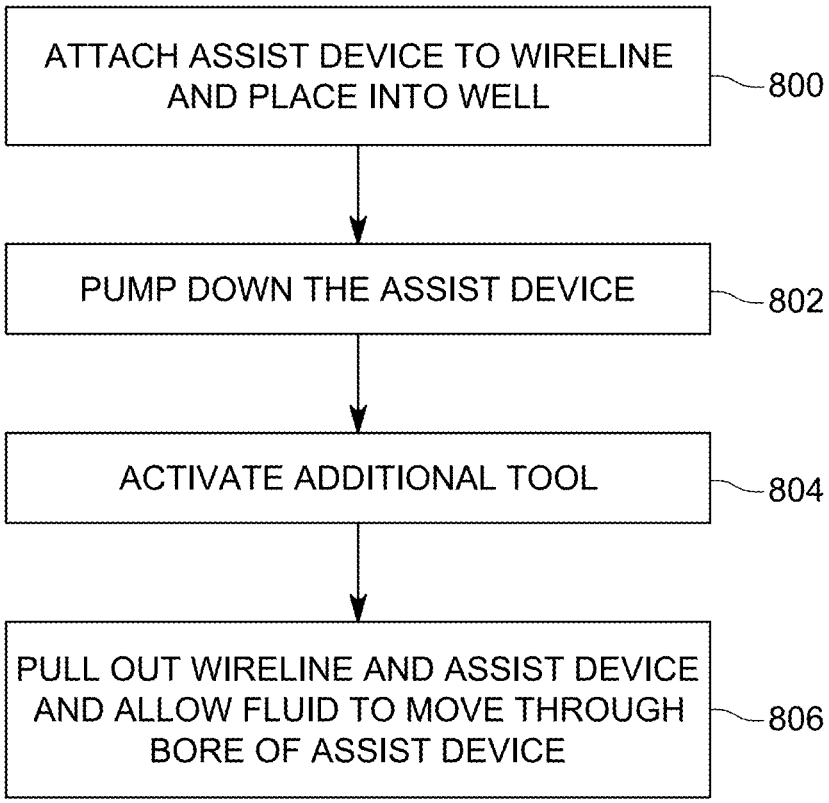
FIG. 8 is a flowchart of a method for deploying/retrieving a well tool with the assist device.
Figure 9:
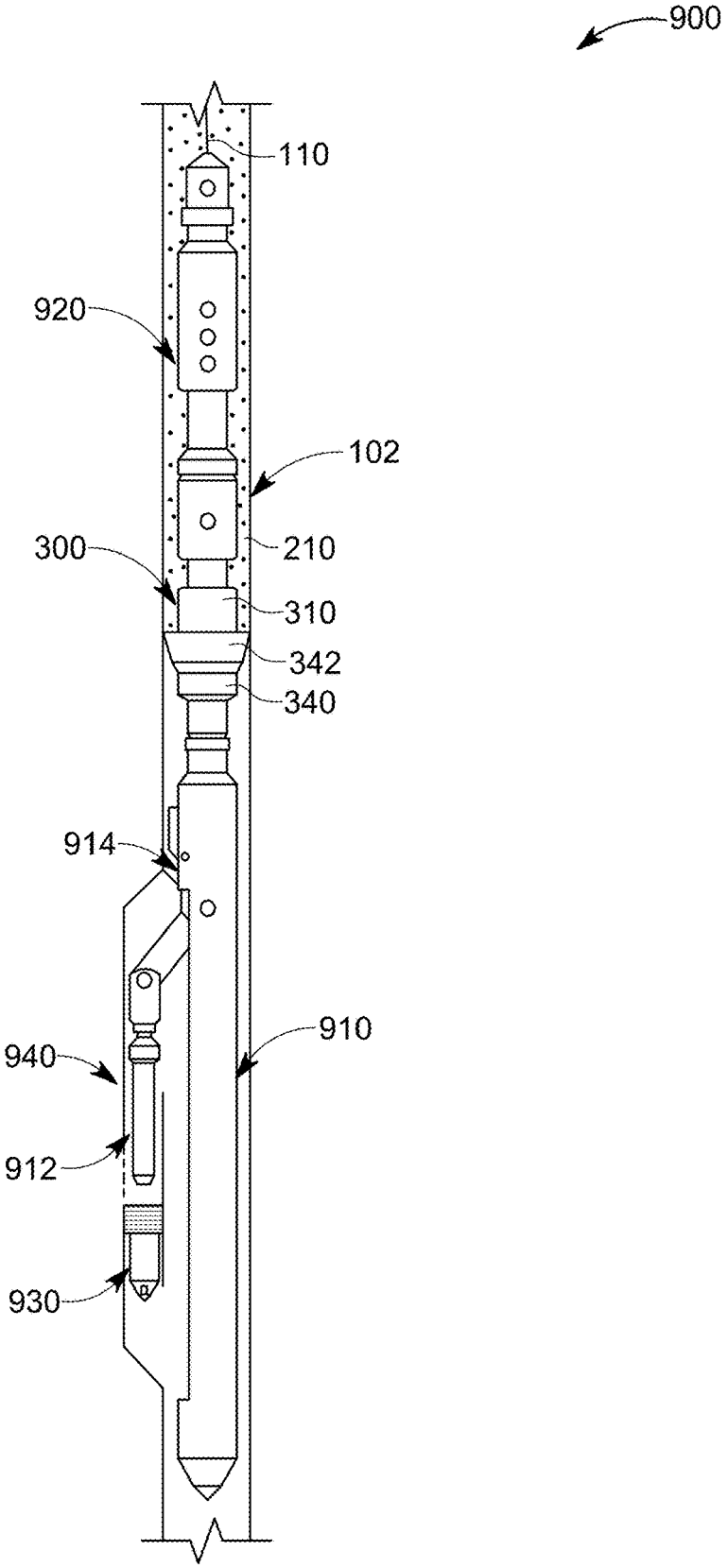
FIG. 9 illustrates a wireline, assist device, and well tool deployed in a well.

A method for using such an assist device for well operations is now discussed with regard to FIGS. 8 and 9. In step 800, the assist device 300 is attached to the wireline 110 and to a servicing tool 910 and this assembly is lowered into the well 102. Additional tools 920 may be added between the wireline 110 and the assist device 300, or between the assist device 300 and the servicing tool 910, or at both locations. The servicing tool may be a kick-over device while the additional tool 920 may be a weight bar. Other types of tools may be employed.

In step 802, if the well is deviated, a fluid 210 (for example water) is pumped from the surface. The fluid 210 is moving down the casing until is reaching the swab cup 342. As previously discussed, the swab cup 342 is pressing against the casing 102 so that almost no fluid is passing by. This means that the pressure exerted by a pump on the fluid is practically transformed into a force that acts downward on the assist tool and helps the wireline to move the tool 910 to the desired location in the well, even if the well is a horizontal well and there the gravity does not move the tool. Note that as discussed with regard to FIG. 6A, the ports 318 in the upstream housing 310 are closed by the head 320A of the stem 320, and thus, the pressured fluid 210 has no path to bypass the assist device 300.

In step 804, when the tool 910 has reached its destination, the tool is activated to either retrieve or to deploy an additional tool. For example, if the tool 910 is a kick-over device, then it usually has a running/pulling arm 912 that is configured to connect to a valve 930. The valve 930 is shown in FIG. 9 to be located in a mandrel 940. Thus, the running/pulling arm 912 engages the valve 930 and pulls it out of the mandrel 940. If the valve is brought by the kick-over device 910 from the surface, then the running/pulling arm 912 is activated by a key 914, which is formed in the casing, extends from the body of the tool 910, and then deploys the valve 930 into the mandrel 940.

In step 806 the wireline 110 and the assist device 300 are pulled out of the casing 102. When this happens, the pump at the surface is stopped, so that no additional pressure is added to the fluid 210. The weight of the fluid 210 that is present above the swab cup 342 pushes downward on the downstream housing 340. The pulling force exerted by the wireline acts upwards on the upstream housing 310. The combination of the force exerted by the fluid and the pulling force exerted by the wireline makes the upstream housing to move relative to the downstream housing, as shown in FIGS. 6B and 7, and to open a fluid path for the fluid 210, through the bores of the assist device 300. In this way, the resistance of the fluid above the assist device is reduced considerably because it is allowed to escape down the casing through the assist device, instead of being pushed up the casing as in the traditional devices.

The assist device 300 discussed herein acts as a one-way valve that is closed when moving down the well and opens up when moving up the well. It prevents a fluid to move through its bore when is pumped down in the well, because of the swab cup, and opens up and allows the fluid to move only through its bore when moving upwards. Thus, the internal mechanism of the assist device (e.g., upstream and downstream housings, stem, string and various ports) controls the opening and closing of its internal bore in response to its movement direction, up or down the well. The closed and opened states are achieved automatically, without human intervention or an electronic controller, which makes the assist device reliable and effective. Also, the assist device does not require electrical power, which makes it less prone to failure.

Figure 10:
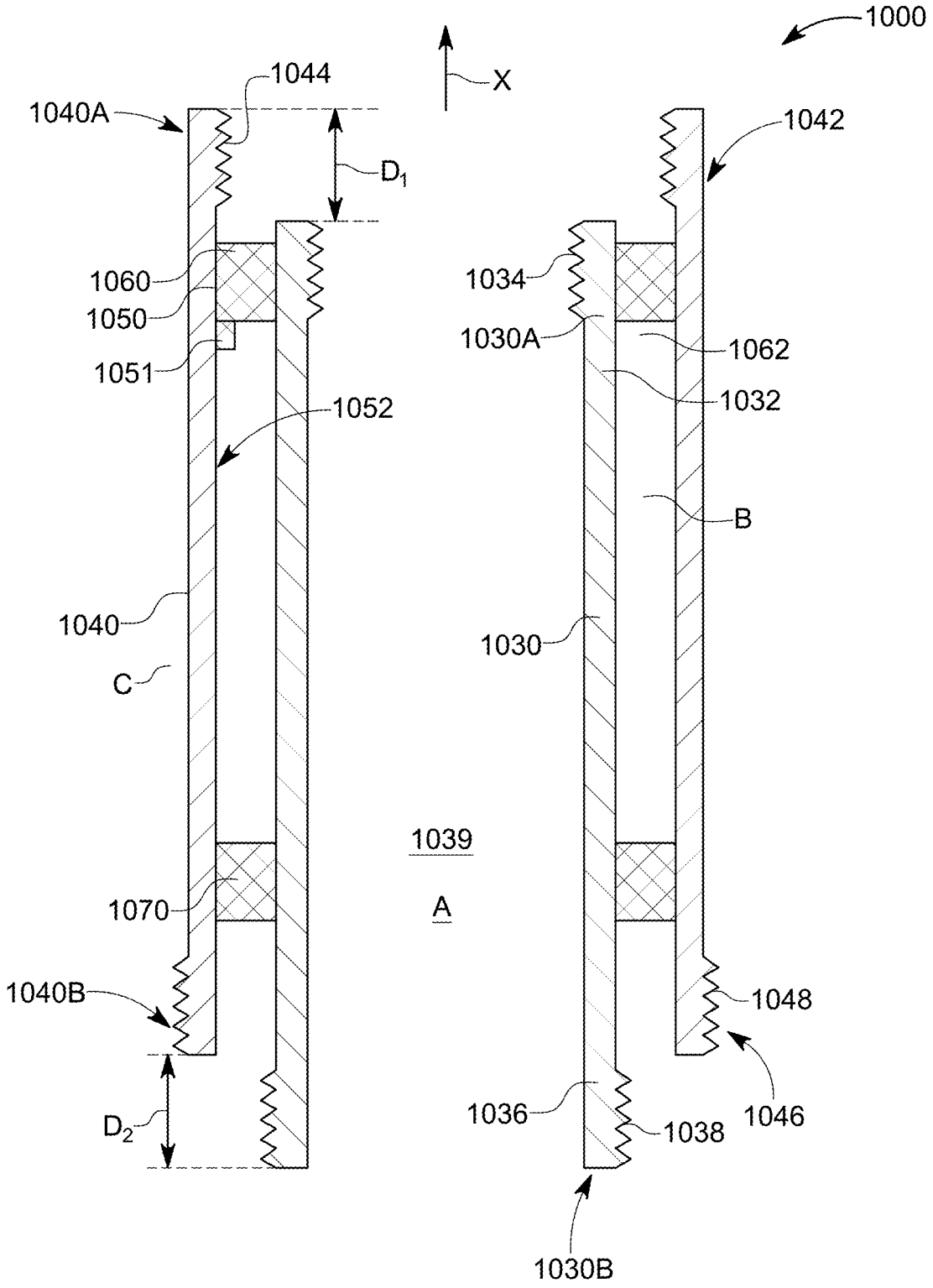
FIG. 10 illustrates a joint pipe element through which the assist device can be deployed.

The assist device 300 can be used with various other tools and in various other environments. For example, the assist device 300 can be used to deploy or retrieve a valve through an inner pipe of a joint pipe element. A joint pipe element 1000 is shown in FIG. 10 as having an inner pipe 1030 and an outer pipe 1040. The upstream end 1040A of the outer pipe 1040 is shaped as a tubular box 1042. This box can be formed, for example, by upsetting or forging (or other known processes). In this embodiment, an internal thread (female) 1044 is formed on the internal part of the tubular box 1042. The downstream end 1040B of the outer pipe 1040 is shaped as a tubular pin 1046 having an external thread (male) 1048, that would mate with a corresponding thread 1044 of a next joint pipe element (not shown).

Two or more upstream lugs 1060 are attached (for example, welded) to the inner pipe 1030 as shown in FIG. 10. The shape of these lugs may be selected as necessary by the manufacturer of the joint pipe element. The inner pipe 1030 is shown having a bore, called herein annulus A as it is customary in the industry, although a bore is different from an annulus. An annulus 1062 is formed between the inner and outer pipes due to the separation introduced by the upstream lugs 1060. The annulus 1062 allows the fluid from the well to pass from one single joint pipe element to another and it is called herein annulus B. Note that a lug 1060 does not extend all the way around the outside circumference of the inner pipe 1030, and thus, the fluid can circulate through the annulus B. The annulus A is in fact the fluid path of the inner tubing string 212 and the annulus B is the fluid path of the outer tubing string 214.

Lug 1060 is in contact with the outer pipe 1040 and may be attached to it also by welding. However, in another embodiment, the lugs 1060 are welded to the inner pipe 1030 and then this assembly is pressed inside the outer pipe 1040, with no welding. The lugs 1060 may engage with a corresponding groove 1050 formed in one of the pipes. A shoulder 1051 of the groove 1050 is configured to stop the lug 1060 from further advancing into the outer pipe. In one embodiment, the size of the lugs is selected to be a little larger than the size of the annulus B, and thus, by pressing the lugs between the two pipes makes the connection of the inner and outer pipes to be fixed, i.e., a torque applied to the outer pipes is transmitted to the inner pipe and thus, the inner pipe cannot rotate relative to the outer pipe or vice versa. In other words, the inner and outer pipes act as a single unit under rotation.

Still with regard to FIG. 10, in one application, the grooves 1050 are formed in the interior surface 1052 of the outer pipe 1040 so that, when the inner pipe 1030 and the upstream lugs 1060 are placed inside the outer pipe 1040, a corresponding lug 1060 stops its movement along the X axis when contacting the corresponding shoulder 1051. The number of grooves coincides with the number of lugs. The groove 1050 is positioned so that an alignment of the inner pipe relative to the outer pipe along the longitudinal axis X is achieved. For example, in the embodiment of FIG. 10, the top most part of the inner pipe 1030 is offset from the top most part of the outer pipe 1040 by a distance D1. In one application, the distance D1 is between a couple of millimeters to a couple of centimeters. In still another application, the distance D1 may be zero, i.e., the top most part of the outer pipe may be flush with the top most part of the inner pipe.

In this embodiment, the inner pipe 1030 is made to have an upstream end 1030A and a downstream end 1030B that are both treaded. The upstream end 1030A is shaped as a tubular box 1032 that has internal (female) threads 1034. The tubular box 1032 may be made, in one application, by upset forging. Other methods may be used to form this part. The downstream end 10306 is shaped as a tubular pin 1036 having an external (male) thread 1038. The inner pipe 1030 has a bore 1039 (that forms the annulus A of the inner tubular string) through which a valve may be lowered into the well or oil may be brought to the surface. As previously discussed, the bore 1039 of the inner pipe 1030 is called annulus A, the annulus between the inner pipe 1030 and the outer pipe 1040 is called annulus B, and the annulus between the outer pipe 1040 and the casing (not shown) is called the annulus C.

Figure 11:
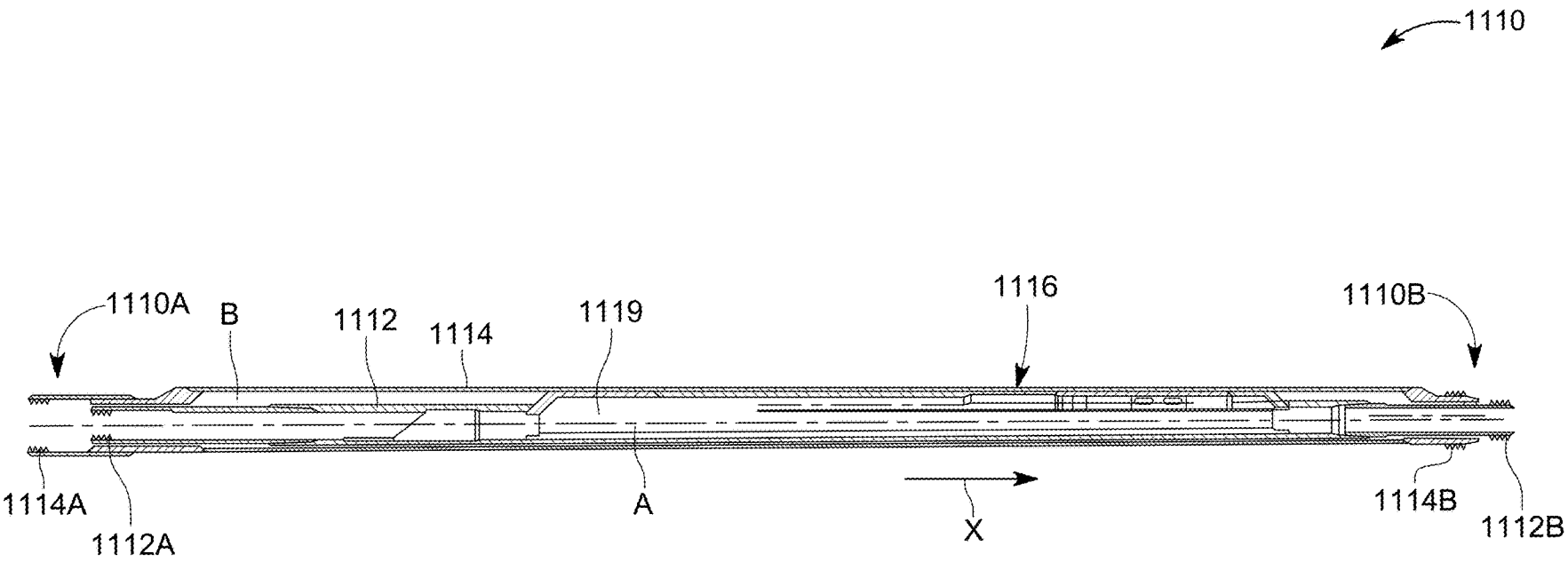
FIG. 11 illustrates a mandrel through which the assist device can be deployed.

For fixing the inner pipe 1030 relative to the outer pipe 1040, in addition to the upstream lugs 1060 discussed above, downstream lugs 1070 may be used at the downstream end of the outer and inner pipes. Two or more downstream lugs 1070 may be used. Although FIG. 10 shows the inner pipe 1030 being concentric relative to the outer pipe 1040, it is possible that only one or both ends of the two pipes to be concentric, while the body (the part between the ends) is not concentric, and this element is called a mandrel or joint pipe mandrel and this element is illustrated in FIG. 11. One or both ends of the two pipes for the joint pipe element or the mandrel are concentric so that the joint pipe element can be attached to another joint pipe element or a connector by a single rotational motion or the mandrel can be attached to a joint pipe element or a connector by a single rotational motion.

FIG. 11 shows a joint pipe mandrel 1110 having an outer member or conduit (pipe) 1114 that houses an inner member or conduit (pipe) 1112. The inner member 1112 defines the annulus A while the outside surface of the inner member 1112 and the inner surface of the outer member 1114 defines the annulus B. A pocket 1116 is attached to the inner member 1112 for housing a valve (not shown). The pocket 1116 partially extends along a length of the inner member 1112 and abuts to the inner surface of the outer member 1114. The pocket 1116 is fluidly insulated from the outer member 1114 except for one or more ports discussed later. The pocket 1116 is also fluidly insulated from the inner member 1112, except for a slot 1119, which is configured to receive a valve deployed through the annulus A. In this way, a flow of a fluid in annulus A is insulated from a flow of another fluid in annulus B and a cross-over from one annulus to another can be controlled at the above noted ports with the valve.

The joint pipe mandrel 1110 has an upstream end 1110A that has threads 1112A formed on the inner part of the inner member 1112 and threads 1114A formed on the inner part of the outer member 1114. The joint pipe mandrel 1110 also has a downstream end 1110B that has threads 1112B formed on the outer part of the inner member 1112 and threads 1114B formed on the outer part of the outer member 1114. The threads on the upstream end of the inner and outer members have the same pitch so that they engage corresponding threads of a joint pipe element or connector simultaneously, with a single rotation motion. The same is true for the threads on the downstream end. In one embodiment, the threads of the upstream end have the same size and configuration as the threads of the downstream end. Those skilled in the art would understand that the threads on either end may be formed on either inner or outer part of the inner and outer members and it is a matter of convenience or choice which part of the inner and outer members holds the threads. In other words, consistent with the terminology of the joint pipe element 1000 discussed in the previous embodiments, the upstream ends of the inner and outer members may be shaped as a tubular box or a tubular pin.

Figure 12:
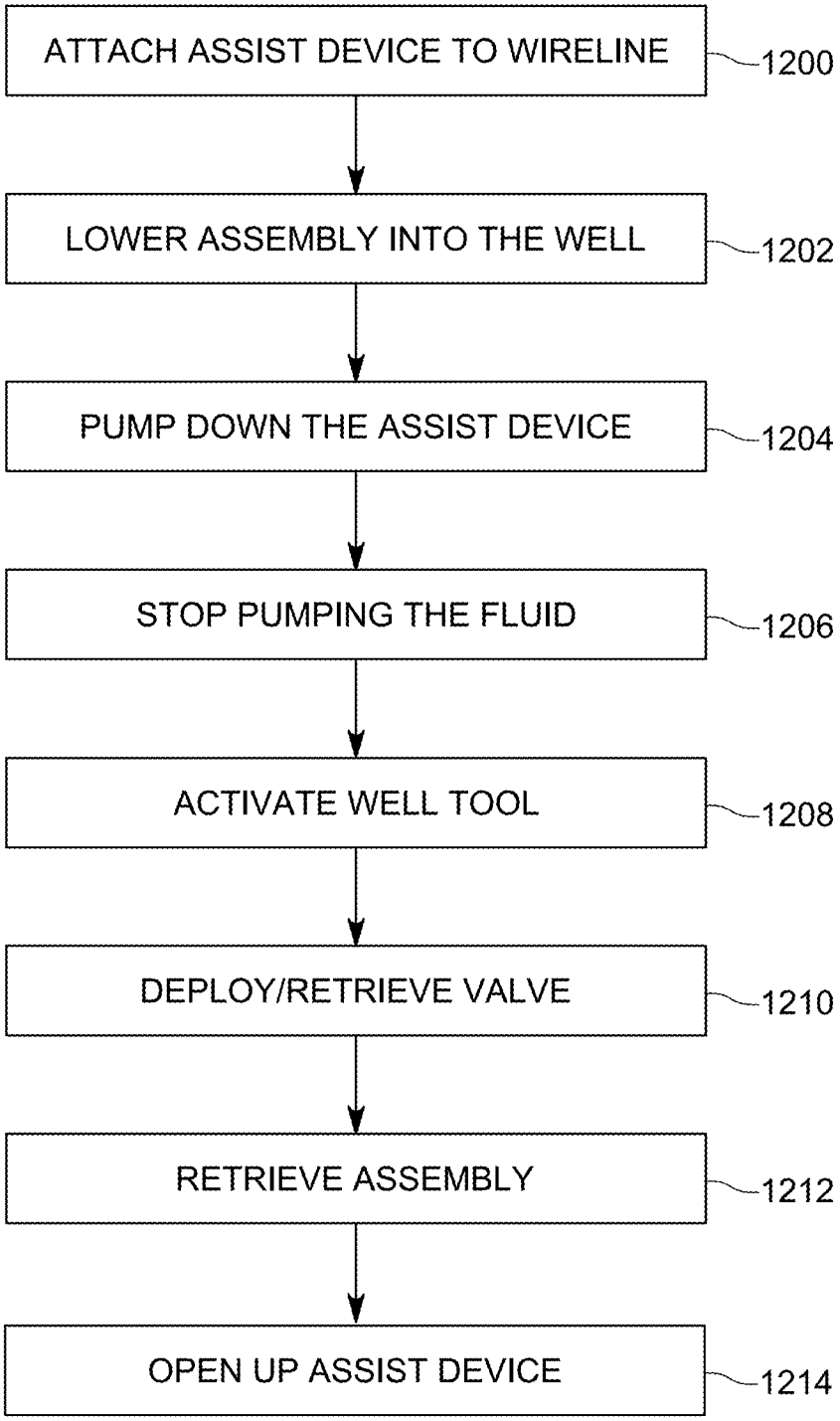
FIG. 12 is a flowchart of a method for well operations that uses an assist device.
Figure 13:
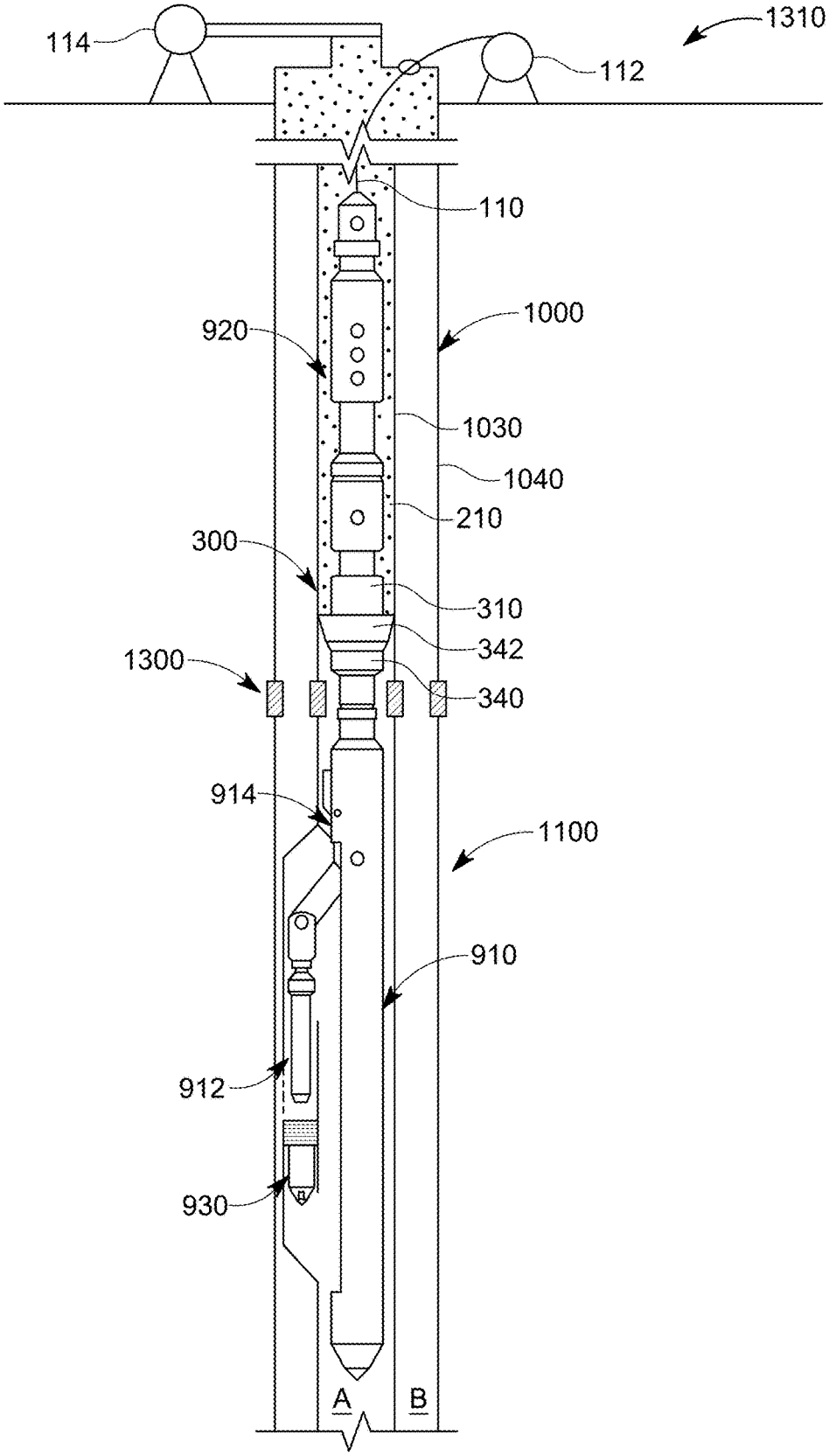
FIG. 13 illustrates an assist device that moves along an inner pipe of a joint pipe element.

A method for using the assist device 300 within a dual concentric tubing system is now discussed with regard to FIG. 12. In step 1200, the assist device 300 is attached between the wireline 110 and a well tool 910 as illustrated in FIG. 13. These elements form a well system 1310. The well tool could be the servicing tool 910 illustrated in FIG. 9. Then, in step 1202, the assist device 300 and the well tool 910 are lowered into the dual concentric tubing system that is already deployed in the casing of the well. The casing of the well is omitted for simplicity. FIG. 13 shows an implementation of such a system in which a joint pipe element 1000 (discussed above with regard to FIG. 10) is connected to a mandrel 1100 (discussed above with regard to FIG. 11) through a connector 1300. Each of these elements have dual concentric annuli. The connector has an inner body that connects the inner pipes of the joint pipe element and the mandrel and also has an outer body that connects the outer pipes of the joint pipe element and the mandrel. Note that the assist device 300 and the well tool 910 are deployed within the inner pipe of the joint pipe element 1000 and thus, the assist device 300 travels exclusively through the annulus A of the tubing system.

In step 1204, a pump 114 pumps a fluid 210 into annulus A of the tubing system to force the assist device 300 to move toward the toe of the well. The swab cup 342 of the assist device 300 is sized to fit tightly inside the annulus A of the joint pipe elements 1000 so that the fluid 210 cannot pass by, as previously explained. When the well tool 910 arrives at the desired position in the well due to the forces exerted by the fluid on the swab cup, the pump stops pumping in step 1206 the fluid 210 so that the assist device 300 stops moving. As the assist device 300 is the "engine" for the well tool 910, especially when deployed in a horizontal well, the well tool also stops.

In step 1208, the well tool 910 is activated, for example, by engaging a key 914 formed into the mandrel 1100. Other means for activating the well tool 910 may be used, for example, sending an electrical or acoustic signal. After the valve 930 is deployed or retrieved by the well tool 910 in step 1210, the entire assembly is retrieved to the surface in step 1212. As the fluid force acting on the downstream housing 340 of the assist device 300 is large, and the force exerted by the wireline 110 on the upstream housing 310 of the assist device 300 points opposite to the fluid force, the assist device automatically opens up in step 1214 and allows the fluid 210 present above the assist device to enter inside the upstream housing and the downstream housing, and thus bypass the swab cup 342, which results in a reduction of the force exerted by the fluid 210 on the assist device. In this way, the entire assembly of the wireline, assist device, and well tool is able to move to the subsurface with less pulling exerted on the wireline.

Figure 14:
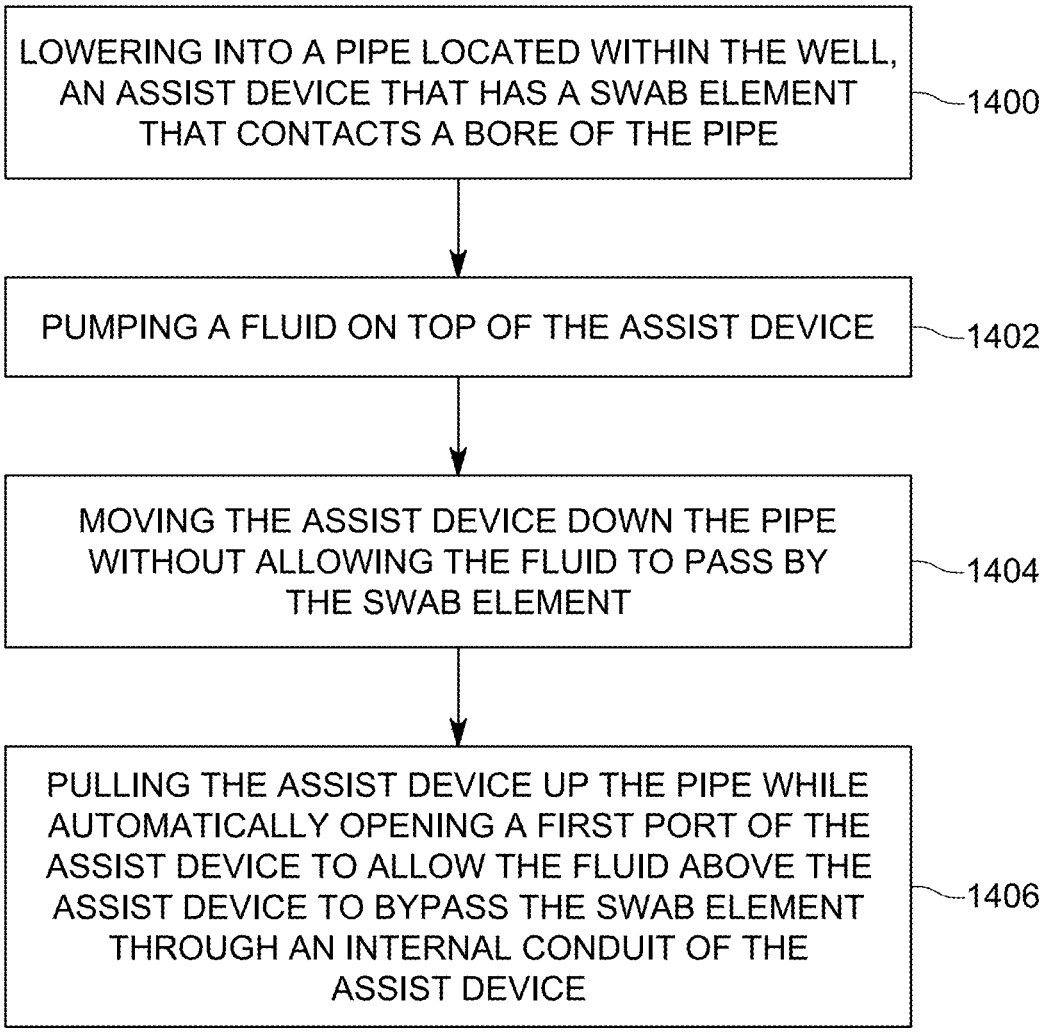
FIG. 14 is a flowchart of another method for well operations that uses an assist device.

Another method for deploying/retrieving a well tool in a well is now discussed with regard to FIG. 14. The method includes a step 1400 of lowering into a pipe located within the well, an assist device that has a swab element that contacts a bore of the pipe, a step 1402 of pumping a fluid on top of the assist device for moving the assist device to a desired location in the well, a step 1404 of moving the assist device down the pipe without allowing the fluid to pass by the swab element, and a step 1406 of pulling the assist device up the pipe while automatically opening a first port of the assist device to allow the fluid above the assist device to bypass the swab element through an internal conduit of the assist device.

The method may further include a step of attaching an upstream end of the assist device to a wireline and a step of attaching a downstream end of the assist device to a well tool. The well tool may be a kick-over tool that is configured to retrieve or deploy a valve from a mandrel and the pipe may be an inner pipe of a joint pipe element, and the joint pipe element has an outer piper that is concentric to the inner pipe.

The disclosed embodiments describe an assist device that may be used inside a well, with an additional tool, for deploying the additional tool to a desired location in the well, and also may be used with minimum resistance when the tool needs to be taken out of the well. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. An assist device for propelling a tool through a conduit, the assist device comprising:

an upstream housing having a first port;

a downstream housing movably attached to the upstream housing and the downstream housing having a second port;

a swab element attached to the downstream housing; and a stem having an upstream end located in a bore of the upstream housing and having a downstream end located in a bore of the downstream housing, wherein the first port is closed when there is no gap between the upstream housing and the downstream housing, and the first port is open when there is a gap between the upstream housing and the downstream housing.

2. The assist device of claim 1, wherein the second port is always open.

3. The assist device of claim 1, wherein the upstream end is free to move inside the bore of the upstream housing.

4. The assist device of claim 3, wherein the downstream end is fixedly attached to the downstream housing.

5. The assist device of claim 4, further comprising:

a spring located around the stem and configured to bias the upstream housing toward the downstream housing.

6. The assist device of claim 1, wherein the first port fluidly communicates with the bore of the upstream housing, and the second port fluidly communicates with the bore of the downstream housing.

7. The assist device of claim 6, wherein the stem has a bore that fluidly communicates with the bore of the upstream housing and with the bore of the downstream housing.

8. The assist device of claim 1, wherein a head of the stem closes and opens the first port.

9. The assist device of claim 1, wherein a fluid cannot pass through a bore of the assist device when the first port is closed, and the fluid passes only through the bore of the assist device when the first port is opened.

10. The assist device of claim 1, wherein the swab element extends along an entire external circumference of the downstream housing.

11. A well system for deploying a well tool at a desired position in a well, the well system comprising:

a wireline;

an assist device attached to the wireline; and a well tool attached to the assist device, wherein the assist device has a swab element that seals a pipe in which the assist device is deployed, so that a fluid above the assist device pushes the swab element down the pipe, and wherein the assist device has a stem having an upstream end located in a bore of an upstream housing and having a downstream end located in a bore of a downstream housing.

12. The well system of claim 11, wherein the assist device opens up when retrieved from the pipe and allows the fluid above the assist device to pass through a bore of the assist device, to bypass the swab element.

13. The well system of claim 11, wherein the assist device comprises:

the upstream housing having a first port;

the downstream housing movably attached to the upstream housing and the downstream housing having a second port; and the swab element is attached to the downstream housing.

14. The well system of claim 13, wherein the first port is closed when there is no gap between the upstream housing and the downstream housing, and the first port is open when there is a gap between the upstream housing and the downstream housing.

15. The well system of claim 13, wherein the second port is always open.

16. The well system of claim 11, wherein the upstream end is free to move inside the bore of the upstream housing.

17. The well system of claim 16, wherein the downstream end is fixedly attached to the downstream housing.

18. The well system of claim 17, further comprising:

a spring located around the stem and configured to bias the upstream housing toward the downstream housing.

19. The well system of claim 13, wherein the first port fluidly communicates with the bore of the upstream housing, and the second port fluidly communicates with the bore of the downstream housing.

20. The well system of claim 19, wherein the stem has a bore that fluidly communicates with the bore of the upstream housing and with the bore of the downstream housing.

21. The well system of claim 13, wherein a head of the stem closes or opens the first port.

22. The well system of claim 13, wherein a fluid cannot pass through a bore of the assist device when the first port is closed, and the fluid passes only through the bore of the assist device when the first port is opened.

23. The well system of 12, wherein the pipe is an inner pipe of a joint pipe element, and the joint pipe element has an outer pipe that is concentric to the inner pipe.

24. The well system of claim 23, wherein the well tool is deployed in a mandrel that has at one end two concentric pipes.

25. A method for deploying/retrieving a well tool in a well, the method comprising:

lowering into a pipe located within the well, an assist device that has a swab element that contacts a bore of the pipe, an upstream housing and a downstream housing;

pumping a fluid on top of the assist device;

moving the assist device down the pipe without allowing the fluid to pass by the swab element; and pulling the assist device up the pipe while automatically opening a first port of the assist device to allow the fluid above the assist device to bypass the swab element through an internal conduit of the assist device, wherein a stem has an upstream end located in a bore of the upstream housing and has a downstream end located in a bore of the downstream housing.

26. The method of claim 25, further comprising:

attaching an upstream end of the assist device to a wireline; and attaching a downstream end of the assist device to a well tool.

27. The method of claim 26, wherein the well tool is a kick-over tool that is configured to retrieve or deploy a valve from a mandrel.

28. The method of claim 25, wherein the pipe is an inner pipe of a joint pipe element, and the joint pipe element has an outer piper that is concentric to the inner pipe.

29. The method of claim 25, wherein the swab element seals the pipe so that the fluid pushes down the assist device.

30. The method of claim 29, wherein the assist device comprises:

the upstream housing having the first port;

the downstream housing movably attached to the upstream housing and the downstream housing having a second port; and the swab element attached to the downstream housing, wherein the first port is closed when there is no gap between the upstream housing and the downstream housing, and the first port is open when there is a gap between the upstream housing and the downstream housing.

31. The method of claim 30, wherein the second port is always open.

32. The method of claim 25, wherein the upstream end is free to move inside the bore of the upstream housing and the downstream end is fixedly attached to the downstream housing.

33. The method of claim 32, wherein the assist device includes a spring located around the stem and configured to bias the upstream housing toward the downstream housing.

34. The method of claim 30, wherein the first port fluidly communicates with the bore of the upstream housing, the second port fluidly communicates with the bore of the downstream housing, and the stem has a bore that fluidly communicates with the bore of the upstream housing and with the bore of the downstream housing.

35. The method of claim 25, wherein a fluid cannot pass through a bore of the assist device when the first port is closed, and the fluid passes only through the bore of the assist device when the first port is opened.

* * * * *